US007806051B2

(12) United States Patent
Schaede

(10) Patent No.: US 7,806,051 B2
(45) Date of Patent: Oct. 5, 2010

(54) DRIVE OF THE INKING UNIT IN AN INTAGLIO PRINTING MACHINE

(75) Inventor: Johannes Georg Schaede, Würzburg (DE)

(73) Assignee: KBA-GIORI S.A., Lausanne (CH)

( * ) Notice: Subject to any disclaimer, the term of this patent is extended or adjusted under 35 U.S.C. 154(b) by 527 days.

(21) Appl. No.: 10/543,542

(22) PCT Filed: Jan. 21, 2004

(86) PCT No.: PCT/IB2004/000239

§ 371 (c)(1),
(2), (4) Date: Mar. 22, 2006

(87) PCT Pub. No.: WO2004/069538

PCT Pub. Date: Aug. 19, 2004

(65) Prior Publication Data

US 2006/0162591 A1 Jul. 27, 2006

(30) Foreign Application Priority Data

Feb. 3, 2003 (EP) ..... 03002144

(51) Int. Cl.

| | |
|---|---|
| ***B41F 9/02*** | (2006.01) |
| ***B41F 9/00*** | (2006.01) |
| ***B41F 31/00*** | (2006.01) |
| ***B41M 1/12*** | (2006.01) |
| ***B41M 1/10*** | (2006.01) |

(52) U.S. Cl. ..... 101/152; 101/153; 101/170; 101/349.1

(58) Field of Classification Search ..... 101/150, 101/153, 170, 216, 217, 152, 154, 349.1
See application file for complete search history.

(56) References Cited

U.S. PATENT DOCUMENTS

| | | | | |
|---|---|---|---|---|
| 1,883,227 | A | 10/1932 | Wood | |
| 2,987,993 | A | 6/1961 | Giori | |
| 4,516,496 | A | 5/1985 | Giori | |
| 5,062,359 | A | 11/1991 | Giori | |
| 5,125,336 | A * | 6/1992 | Germann | 101/137 |
| 5,826,505 | A * | 10/1998 | Volz et al. | 101/183 |
| 5,899,145 | A | 5/1999 | Schaede | |
| 6,041,706 | A * | 3/2000 | Murray | 101/217 |
| 6,293,194 | B1 * | 9/2001 | Vrotacoe | 101/248 |
| 6,810,810 | B2 * | 11/2004 | Anweiler et al. | 101/484 |
| 7,086,330 | B2 * | 8/2006 | Masuch | 101/217 |

FOREIGN PATENT DOCUMENTS

| | | | |
|---|---|---|---|
| EP | 0 017 844 | A1 | 10/1980 |
| EP | 0 136 972 | A1 | 4/1985 |
| EP | 0 563 007 | A1 | 9/1993 |
| WO | WO 03039872 | A1 * | 5/2003 |

* cited by examiner

*Primary Examiner*—Judy Nguyen
*Assistant Examiner*—Leo T Hinze
(74) *Attorney, Agent, or Firm*—Crompton, Seager & Tufte, LLC

(57) ABSTRACT

The machine comprises at least a plate cylinder carrying printing plates with engravings corresponding to a specific intaglio structure to be printed, and cooperating with an impression cylinder, a collector cylinder (8) on which the ink in the different colors is deposited by selector cylinders (10), each selector cylinder (10) receiving ink of a given color from a duct roller (11) and each selector cylinder (10) is driven by drive means (20,21,22) in an independent manner.

13 Claims, 3 Drawing Sheets

DRIVE OF THE INKING UNIT IN AN INTAGLIO PRINTING MACHINE

The present invention concerns an intaglio printing machine.

BACKGROUND OF THE INVENTION

Intaglio printing machines are known in the prior art, especially for the printing of securities such as bank-notes and other similar objects. For example, U.S. Pat. No. 5,062,359, the content of which is enclosed by reference in the present application, discloses a sheet-fed or web-fed intaglio printing machine. This machine comprises a plate cylinder with several printing plates, an impression cylinder, a wiping device and an inking system with a collector inking cylinder, having an elastic surface, interacting with the printing plates, with selective inking cylinders having reliefs corresponding to the coloured zones to be printed in different colours and in contact with the periphery of the collector inking cylinder, and of an inking device associated with each selective colour inking cylinder.

Another machine is disclosed for example in U.S. Pat. No. 4,516,496, the content of which is enclosed by reference in the present application. This patent also discloses an intaglio printing machine similar to the one of U.S. Pat. No. 5,062,359 mentioned above. As shown in this patent, the inking system comprises a plurality of selector cylinders which are used for transferring the ink in a given colour from the inking units onto the collector cylinder, which in turn inks the engravings of the plates. Each selector cylinder has a hard surface, for example surfaces lined with hardened rubber, plastic or the like, or metal, each selector cylinder comprising relief areas having contours corresponding exactly to the contours of the surface to be printed with the corresponding colour.

Another example of an intaglio printing machine is disclosed in U.S. Pat. No. 5,899,145, the content of which is enclosed by reference in the present application.

A problem which is present in this field resides in the fact that the inking of the intaglio structure, in particular of the plates is not precise, therefore ink is transferred on a larger area than the effective intaglio structure, this ink being later wiped away by the wiping system. Accordingly, a high quantity of ink is lost because it is deposited outside the places effectively corresponding to engravings of the plates, and is then wiped away without being used for inking the plates.

Another problem one is faced with in this printing technique is the fact that, due to the high pressure necessary for the printing operation, the plates undergo an elongation deformation over their lifetime which is then prejudicial to the perfect register between the blankets of the collector cylinder and the plates with the engravings. For this reason, ink is also deposited outside the engravings and is lost by the wiping operation.

In order to avoid this loss of unused ink, one thus tries to increase the precision of depositing the ink in the engravings of the plates.

SUMMARY OF THE INVENTION

It is therefore an aim of the present invention to improve the known machines and methods.

Another aim of the present invention is to reduce the quantity of ink necessary for the printing without diminishing quality of the printing.

A further aim of the present invention is to improve preciseness of the inking of the plate cylinder by the collector cylinder.

These aims are attained by a specific drive in the inking system.

To fulfil these aims, the invention is defined by the subject-matter of the claims.

According to the invention, one uses a conventional inking method, polymer plates for the blankets and one compensates the elongation of the metal Ni printing plates by creating different ink deposition size on the blankets by a separate drive of the selector cylinders. Thus, it is necessary to have an equal number of metal plates and blankets for each blanket to correspond to one plate, to be able to compensate the elongation of the plates.

Several embodiments of the invention are now described with reference to the drawings in which.

DETAILED DESCRIPTION OF THE EMBODIMENTS

Figure 1:
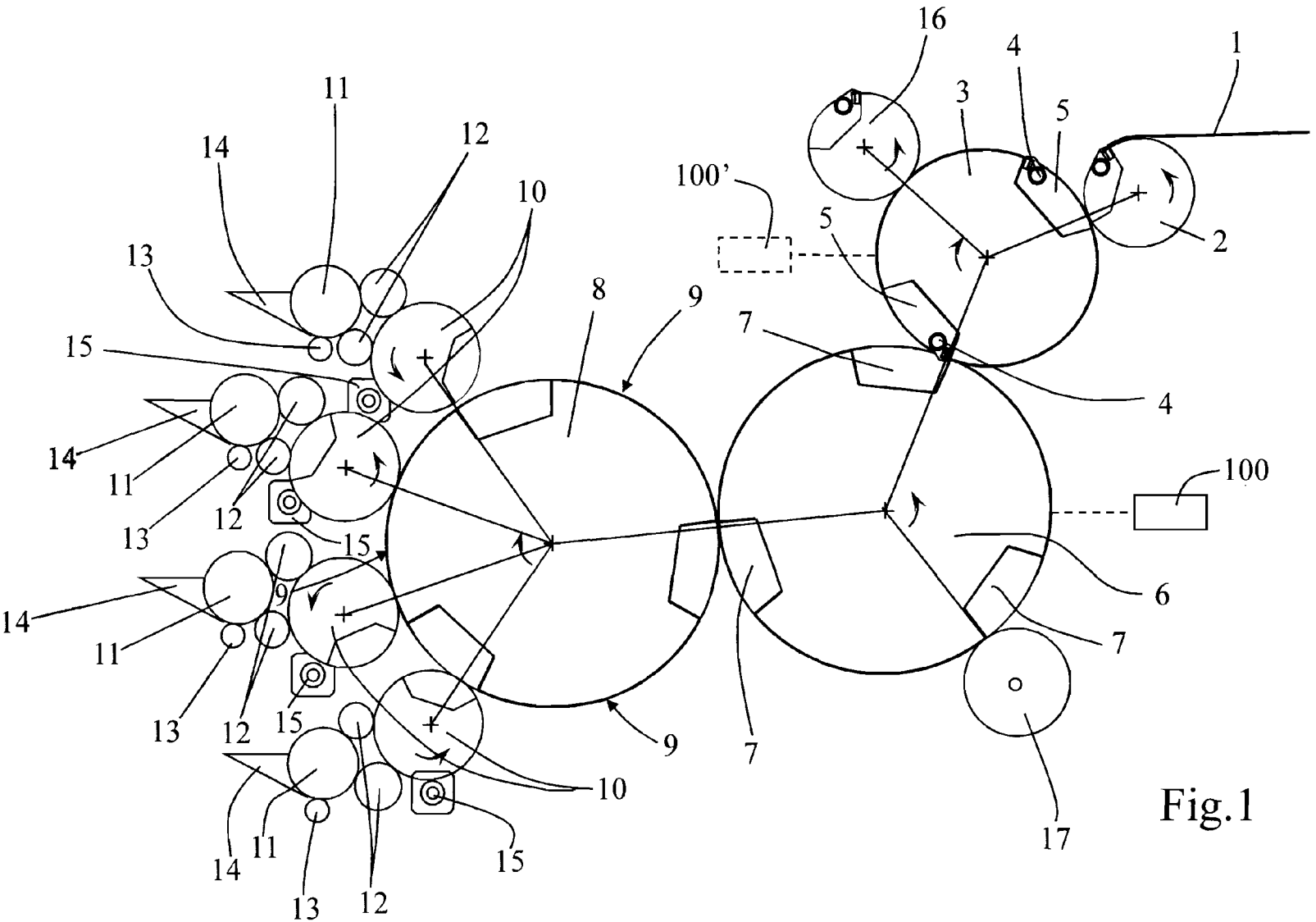
FIG. 1 shows the principle of an intaglio printing machine according to the invention.

The principle of functioning of an intaglio sheet-web or web-fed printing machine, known per se in the art of printing, is described first with reference to FIG. 1, with the different cylinders rotating in the direction shown by the arrows. The following description of the printing is given for a sheet-fed printing machine, however the same principles apply also to a web-fed printing machine. In the machine, the sheets 1 arrive from a feeding system (not shown) and are transferred by a transfer cylinder 2 onto an impression cylinder 3. The sheets are held on this impression cylinder 3 by grippers 4 for the impression process, said grippers being placed in cylinder pits 5. In the example shown, the impression cylinder 3 has two segments, each supporting one sheet to be printed. The impression cylinder 3 cooperates with a plate cylinder 6, both cylinders 3 and 6 forming a printing nip in which the sheet undergoes the intaglio printing process. The plate cylinder 6 carries three plates in the example of FIG. 1, said plates being held by gripping systems (not shown), known per se in the art, placed into plate cylinder pits 7. The plates, as is known in the art of printing, carry engravings corresponding to the design to be printed, and the engravings of the plates further receive the ink which is being deposited on the successive sheets.

Next to the plate cylinder 6, there is a blanket cylinder 8, also called collector cylinder, which is used to ink the plates of the plate cylinder 6. As is schematically represented in FIG. 1, the blanket cylinder 8 carries three blankets 9. The blankets 9 form a smooth surface on the cylinder 8 and they receive ink from selector cylinders 10 distributed along the periphery of the blanket cylinder 8. Each selector cylinder 10 is inked in a given colour by an inking device. The selector cylinders 10 have a surface which is harder than the surface of the blankets 9 of the blanket cylinder 8 and their surface is divided into sections with reliefs areas having contours corresponding exactly to the contours of the engravings of the plates which are destined to receive the ink of each respective selector cylinder 10.

As is common in the art, each selector cylinder is associated with an inking device comprising at least a duct roller 11, ink transfer rollers 12, an oscillator roller 13, an inker 14 containing the ink of a given colour and a drive motor 15 for driving the selector cylinders 10.

The ink contained in the inkers 14 is transferred from the duct rollers 11 onto the selector cylinders 10 through ink transfer rollers 12 and then from the selector cylinders 10 onto the plate cylinder 6 through the blanket cylinder 8 and the blankets 9. The oscillator rollers 13 are used to ensure a constant thickness of ink on the duct roller. The excess of ink on the plate cylinder 6 is further wiped away by wiping cylinder 17.

Once the sheets 1 have passed the printing nip formed between the plate cylinder 6 and the impression cylinder 3 and have received the intaglio printing, they are taken away from the impression cylinder 3, for example by a delivery cylinder 16 for further treatment.

Figure 2B:
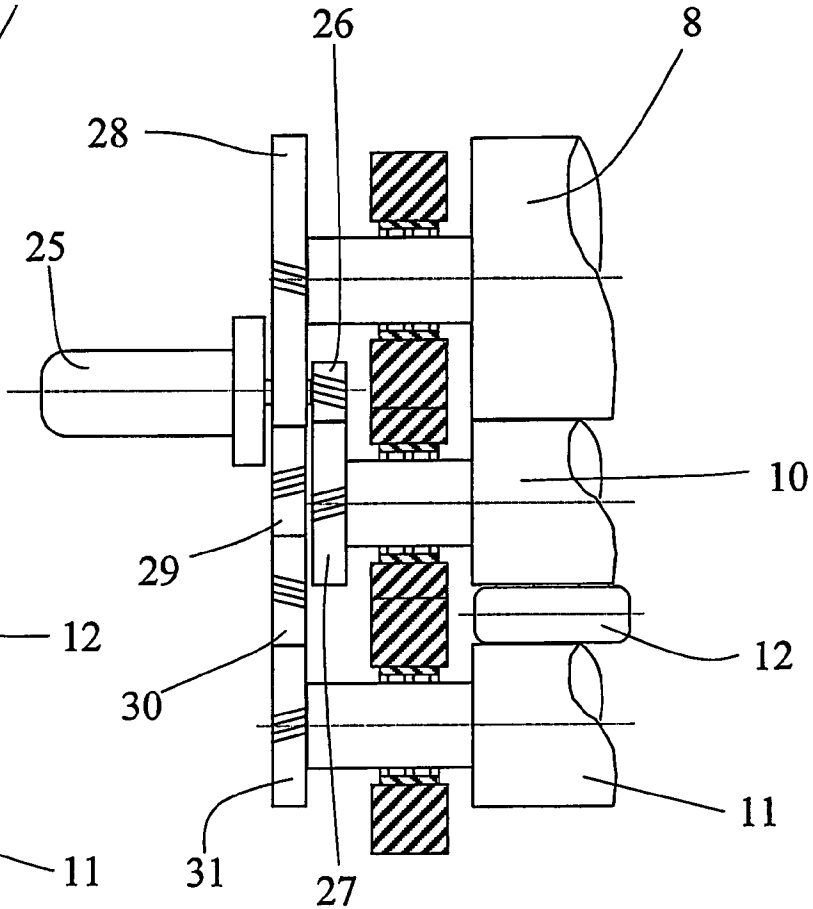
FIGS. 2A and 2B show two different drives of selector cylinders.
Figure 2A:
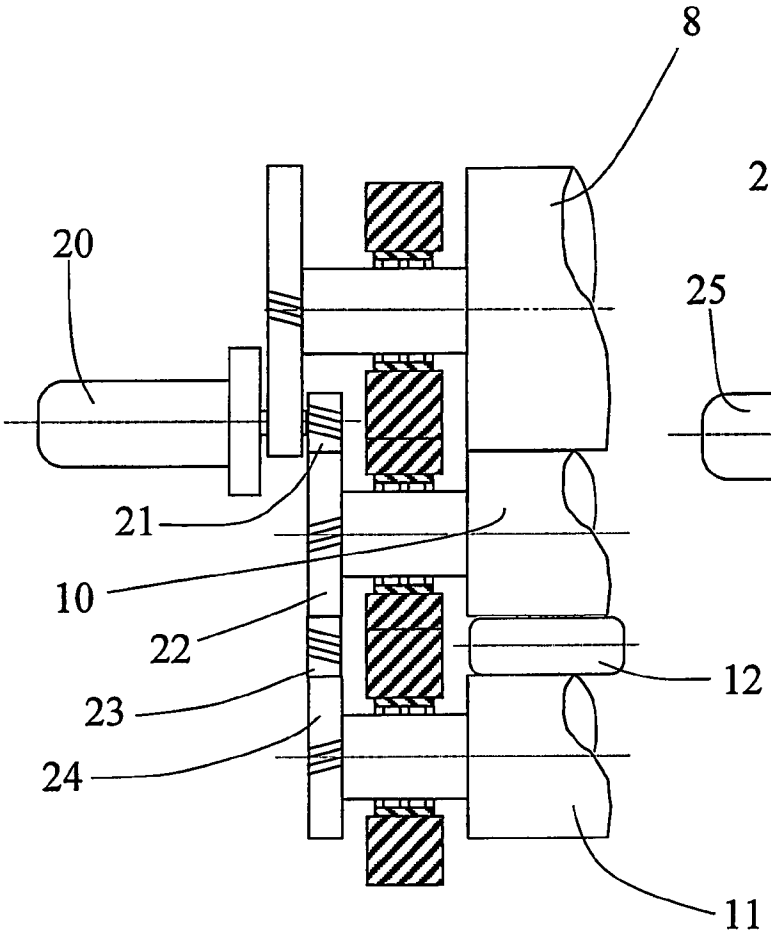

FIG. 2A shows a first embodiment of a drive system for the selector cylinders 10, in which the drive system comprises a drive motor 20 (corresponding to drive motor 15 of FIG. 1) that drives the selector cylinder 10 and the duct roller 11 through several pinions 21 to 24. This embodiment can be referred to as an inline drive of the selector cylinder and duct roller. This drive system allows an independent motion of the selector cylinder 10 driven by motor 20, and, as a consequence, it is possible to vary the inking print length on the blankets 9 of the blanket cylinder 8 to compensate the elongation of the printing plates, i.e. by reducing or increasing the distance which the surface of the selector cylinder 10 is moving with respect to the distance the surface of the blanket cylinder 8 moves in the same time increment. The aim being to vary the relative motion of both cylinders to compensate the elongation of the plate.

The motor 20 able to drive the pinions 21 to 24 in this embodiment typically needs a power of 6 to 10 kW to drive the selector cylinder 10 and the duct roller 11.

In a second embodiment of the invention, represented in FIG. 2B, the motor 25 only drives the selector cylinder 10 though pinions 26, 27 and the duct roller 11 is driven separately with the blanket cylinder, through pinions 28, 29, 30 and 31. As in the present embodiment, the independent drive of the selector cylinder 10 by motor 25 allows a variation of its displacement relatively to the displacement of the blanket cylinder 8, thus allowing to vary the length of ink deposited on said blanket cylinder in order to compensate an elongation of the plate.

The second embodiment has the advantage that the motor 25 needs less power and can develop typically less than 2 kW to drive the selector cylinder 10.

Figure 3:
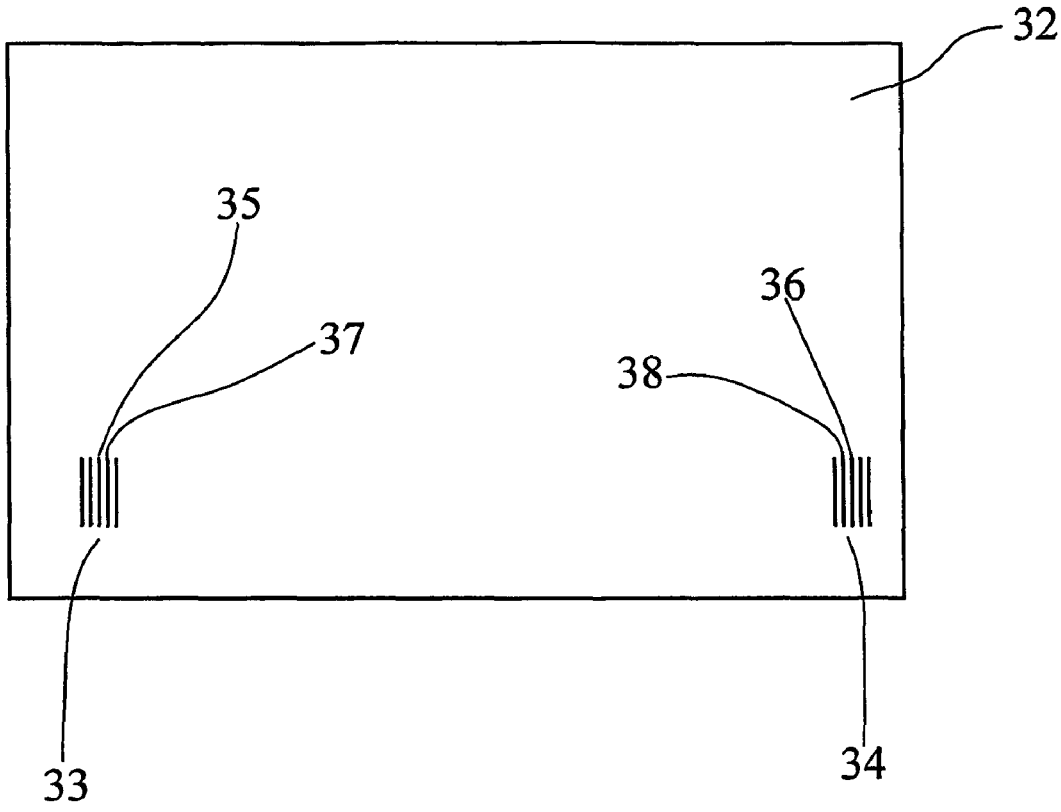
FIG. 3 shows a measurement method for the elongation of the plates.

A system suitable for controlling the elongation of a plate is described with reference to FIG. 3. This system comprises two sets 33, 34 of several lines, for example five lines each, which are engraved at each end of a plate. With an intaglio process, these sets 33, 34 of lines are then reproduced on the substrate 32, for example a security document, of FIG. 3. However, before the intaglio process is applied to the substrate, ink is deposited by the blanket cylinder 8 only in the engravings of the plate corresponding to the middle line 35, 36 of each set 33, 34 of lines. Therefore, after the intaglio printing process, each substrate will have two sets 33, 34 of lines reproduced, but only one line (the middle lines 35, 36) in each set 33, 34 will be inked.

If the plate undergoes an elongation during the printing of a run of sheets, the ink of the blanket cylinder 8 will not be deposited in the engraving corresponding to the middle lines 35, 36, but it will be shifted laterally and be deposited in the engravings corresponding to lines 37, 38 which are next to said middle lines 35, 36, in the direction contrary to the elongation of the plate since the size of the blanket cylinder 8 does not change. It will then be easy to control on the printed substrate 32 that the inked lines are not the middle lines 35, 36 anymore, but, for example, lines 37, 38 and a correction on the drive of the selector cylinders 10 can be then carried out to compensate the elongation of the plate.

As a means to control this elongation, it is possible to use optical devices such as a video camera or other equivalent devices. Such devices are known in the art of printing machine, in particular for securities and similar objects, and are commonly used to control the quality of the printing. A schematically illustrated optical device 100 for measuring the elongation of the printing plates directly on the plate cylinder is shown in FIG. 1 and a schematically illustrated optical device 100' for measuring the elongation of the printing plates indirectly on the printed substrates 1 after they have been printed at the printing nip between the plate cylinder 6 and the impression cylinder 3 is also shown. The optical device then either controls the plate itself and allows to determine which lines of the set of lines 33, 34 are effectively inked and whether there is a lateral shift in the ink deposition indicating a deformation (i.e. elongation) of the plate, or it can control the printed substrate 32 itself after the printing operation to determine which lines are effectively printed with ink on the substrate and thus the deformation of the plate, if any.

The embodiments of the invention described are given by way of example and are not to be construed in a limiting manner. Alternatives and equivalent means are of course within the scope of protection defined by the claims.

The invention claimed is:

1. Intaglio printing machine comprising at least a plate cylinder carrying printing plates with engravings corresponding to a specific intaglio structure to be printed on a substrate, and cooperating with an impression cylinder carrying the substrate to be printed, a collector cylinder with at least one blanket on which ink in different colours is deposited by selector cylinders, each selector cylinder receiving ink of a given colour from an associated inking device and having reliefs with contours corresponding to the area of the intaglio structure to be inked with said given colour, wherein said intaglio printing machine further comprises means for varying the length of ink deposited on said collector cylinder by said selector cylinders, said means including drive means for driving the selector cylinders into rotation independently of said collector cylinder.

2. Intaglio printing machine as defined in claim 1, wherein said drive means comprise at least a motor.

3. Intaglio printing machine as defined in claim 2, wherein each motor drives the associated selector cylinder through an arrangement of pinions.

4. Intaglio printing machine as defined in claim 3, wherein each inking device comprises a duct roller which is driven together with the associated selector cylinder by said motor through a second arrangement of pinions.

5. Intaglio printing machine as defined in claim 3, wherein each inking device comprises a duct roller which is driven together with said collector cylinder through a second arrangement of pinions.

6. Intaglio machine as defined in claim 1, further comprising means for determining elongation of an individual printing plate, said means including a pattern engraved in said printing plate which is reproduced on the substrate to be printed and allows determination of the elongation of the individual plate and correction of the relative motion of the selector cylinders with respect to the collector cylinder.

7. Intaglio machine as defined in claim 6, wherein said engraving pattern comprises two sets of parallel lines.

8. Intaglio printing machine as defined in claim 1, further comprising an optical device for measuring the elongation of the plate and feeding back this elongation for the correction of the relative motion of the selector cylinders with respect to the collector cylinder.

9. A method of inking a plate cylinder in an intaglio printing machine comprising a collector cylinder for inking the plate cylinder and on which ink in different colours is deposited by selector cylinders, wherein said method comprises the step of driving the selector cylinders into rotation independently of said collector cylinder so as to vary the length of ink deposited on said collector cylinder by said selector cylinders.

10. The method as defined in claim 9, further comprising the steps of determining elongation of a printing plate carried by said plate cylinder and correcting the drive of the selector cylinders to compensate for said elongation.

11. The method as defined in claim 10, wherein determination of the elongation of the printing plate includes providing the said printing plate with an engraved pattern and determining a shift in the ink deposition on said engraved pattern.

12. The method as defined in claim 11, wherein said engraved pattern includes a set of parallel lines and only one line among said set of parallel lines is inked, and wherein determination of a shift in the ink deposition includes determining which line among said set of parallel lines is inked.

13. The method as defined in claim 10, wherein determination of the elongation of the printing plate is performed by an optical device.

* * * * *